US006296389B1

(12) United States Patent
Yamamoto et al.

(10) Patent No.: US 6,296,389 B1
(45) Date of Patent: Oct. 2, 2001

(54) EASY-TO-OPEN PACKING BAG

(75) Inventors: Sadao Yamamoto, Saijo; Shin Yamada; Kazutaka Manabe, both of Shinjuku-ku, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/424,563

(22) PCT Filed: Mar. 24, 1999

(86) PCT No.: PCT/JP99/01472

§ 371 Date: Feb. 24, 2000

§ 102(e) Date: Feb. 24, 2000

(87) PCT Pub. No.: WO99/48769

PCT Pub. Date: Sep. 30, 1999

(30) Foreign Application Priority Data

Mar. 25, 1998 (JP) ..... 10-077192

(51) Int. Cl.[7] ..... B65D 33/00
(52) U.S. Cl. ..... 383/210; 206/484
(58) Field of Search ..... 383/200, 210, 383/211; 206/484

(56) References Cited

U.S. PATENT DOCUMENTS 3,342,326 * 9/1967 Zackheim ..... 383/210 X
3,724,651 * 4/1973 Link ..... 383/200 X
3,809,228 * 5/1974 Fowler et al. ..... 383/200 X
4,136,776 * 1/1979 Poncy ..... 383/210 X
4,630,729 * 12/1986 Hirt et al. ..... 383/210 X
4,720,011 * 1/1988 Canamero ..... 383/210 X
4,871,091 * 10/1989 Preziosi ..... 383/210 X

FOREIGN PATENT DOCUMENTS 53-110383 9/1978 (JP) .
6-183481 7/1994 (JP) .

* cited by examiner

*Primary Examiner*—Jes F. Pascua
(74) *Attorney, Agent, or Firm*—Wenderoth, Lind & Ponack, L.L.P.

(57) ABSTRACT

A packing bag is easy to open and allows an end of an content to be easily exposed to the outside by separating heat-bonding portions of external an internal packing films from each other and tearing the external packing film. The packing bag includes two rectangular packing films each having a thermoplastic resinous layer formed on its inner surface. The external and internal packing films are laminated on each other, with surfaces of the thermoplastic resinous layers opposed to each other, a predetermined region extending inward from one side of each of the packing films is formed as a non-bonding portion; a U-shaped peripheral heat-bonding portion is formed on each of the packing films along other three sides thereof, a projected heat-bonding portion connecting both ends of the peripheral heat-bonding portion with each other and projected outward is formed; at least the projected heat-bonding portion is separable; and a notch is formed on at least one edge of an external one of the packing films such that the notch is located at a position adjacent to one end of the peripheral heat-bonding portion.

16 Claims, 4 Drawing Sheets

EASY-TO-OPEN PACKING BAG

TECHNICAL FIELD

The present invention relates to an easy-to-open packing bag that can be opened easily by separating heat-bonding portions from each other.

BACKGROUND ART

Heretofore, an easy-to-open packing bag having the following construction as shown in FIG. 6 is used to pack an elongated flat article such as a blood sugar value measuring electrode therein. Surfaces of thermoplastic resinous layers of two rectangular packing films each consisting of a backing layer and a thermoplastic resinous layer are laminated on each other. One of the shorter sides of each packing film is formed as a non-bonding portion 15. A separable U-shaped peripheral heat-bonding portion 12 is formed along the other three sides of each packing film. A separable mountain-shaped projected heat-bonding portion 13 connecting both ends of the peripheral heat-bonding portion 12 with each other and projected outward is formed and sealed. A pair of confronting partitioning heat-bonding portions 14 projecting inward is formed to the peripheral heat-bonding portion 12 to accommodate a content 7 such as the blood sugar value measuring electrode in a space positioned at one side and a drying agent 8 in a space positioned at the other side. When the packing bag having the above-described construction is used to accommodate the blood sugar value measuring electrode therein, the external and internal packing films of the non-bonding portion 15 are picked up with fingers and pulled in opposite directions, and then, both projected heat-bonding portions 13 are separated from each other from ends thereof to a tearing line 16. Then, the separated portions of the packing films are bent outward to expose an end of the blood sugar value measuring electrode to the outside from the easy-to-open packing bag. Then, the exposed portion is impregnated with blood to measure a blood sugar value. However, the area of the nonbonding portion 15 is not large and thus it is not easy to pick up the non-bonding portion 15. Further, a strong force is required to separate the entire heat-bonding portions 13 from each other from the ends thereof. Thus, if an excess force is applied to the packing films to open the easy-to-open packing bag, the entire packing films separate from each other and the blood sugar value measuring electrode drops from the easy-to-open packing bag. Thus, it is difficult for old men who have to use the blood sugar value measuring electrode frequently to open the easy-to-open packing bag.

DISCLOSURE OF THE INVENTION

It is an object of the present invention to provide an easy-to-open packing bag allowing an end of a content to be easily exposed to the outside by separating heat-bonding portions and tearing the external packing film.

In the easy-to-open packing bag, a pair of rectangular-shaped packing films, each of which comprises a substrate layer and a thermoplastic resinous layer, are laminated on each other, with surfaces of the thermoplastic resinous layers being opposed to each other; a predetermined region on one side of the packing films is formed as a non-heat-bonding portion; a U-shaped peripheral heat-bonding portion is formed on three other sides of the packing films: a projected heat-bonding portion, connecting a pair of ends of the peripheral heat-bonding portion and projecting outwardly, is formed; at least the projected beat-bonding portion is separably sealed; and a notch is formed on at least one of a pair of edges of an external one of the packing films such that said notch is located at a position adjacent to one end of the peripheral heat-bonding portion. In this case, the corner of the non-bonding portion of the external packing film and that of the non-bonding portion of an internal one of the packing films are picked up with fingers and pulled in opposite directions. As a result, the outward end of the projected heat-bonding portion of the external packing film and that of the projected heat-bonding portion of the internal packing film separate from each other, and at the same time, the external packing film starts to tear from the notch. As the separation operation continues, both projected heat-bonding portions separate from each other, and the external packing film tears. That is, the non-bonding portion located at one side of the external packing film with respect to the notch is removed to expose an end of the content. Thus, an easy usage can be realized.

In the easy-to-open packing bag, the heat-bonding strength of the projected heat-bonding portion is set to 500–2000 g per 15 mm width, so that the projected heat-bonding portions can be separated from each other easily when the corner of the non-bonding portion of the external packing film and that of the non-bonding portion of the internal packing film are picked up with fingers and pulled in opposite directions.

In the easy-to-open packing bag, the heat-bonding strength of the projected heat-bonding portion is set lower than that of the peripheral heat-bonding portion, so that even when an excess force is applied to the two packing films in separating the projected heat-bonding portions from each other, the packing films cannot be separated from each other at the peripheral heat at bonding portion. Thus, there is no possibility that the two films are separated from each other and that the content drops from the easy-to-open packing bag.

In the easy-to-open packing bag, a heat-bonding strength adjusting layer is applied to the region of the surface of the thermoplastic resinous layer of each packing film on which the projected heat-bonding portion is to be formed. In this manner, it is possible to reduce the heat-bonding strength of the projected heat-bonding portion.

DETAILED DESCRIPTION OF THE INVENTION

The embodiments of the present invention will be described below with reference to the drawings.

Figure 1:
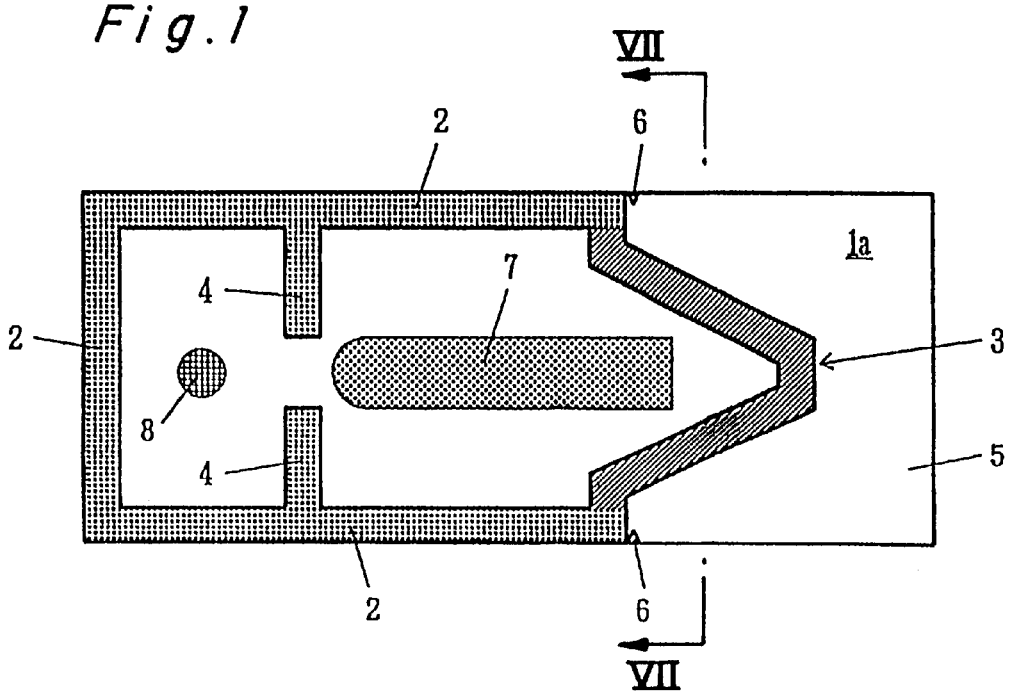
FIG. 1 is a plan view showing an easy-to-open packing bag according to a first embodiment of the present invention.

FIG. 1 is a plan view showing an easy-to-open packing bag according to a first embodiment of the present invention.

Figure 2:
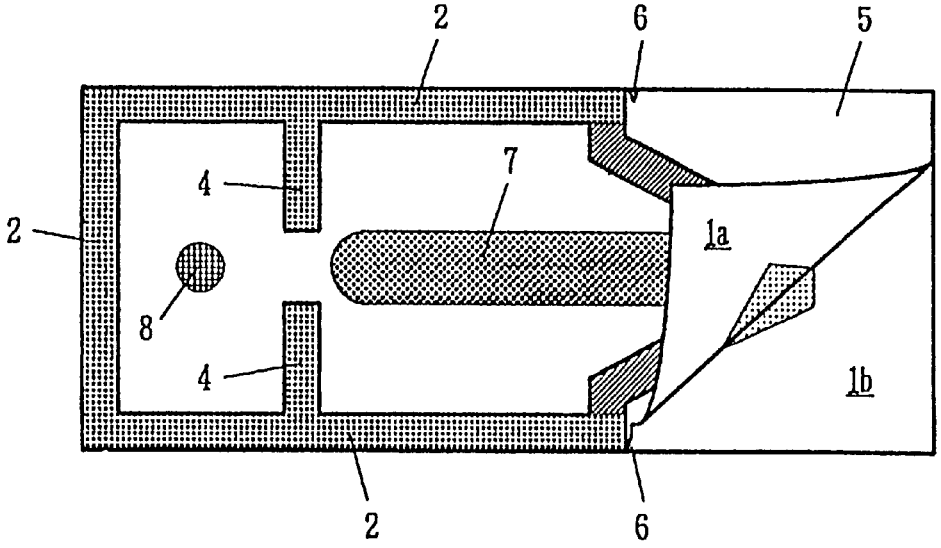
FIG. 2 shows the easy-to-open packing bag according to the first embodiment being opened.
Figure 3:
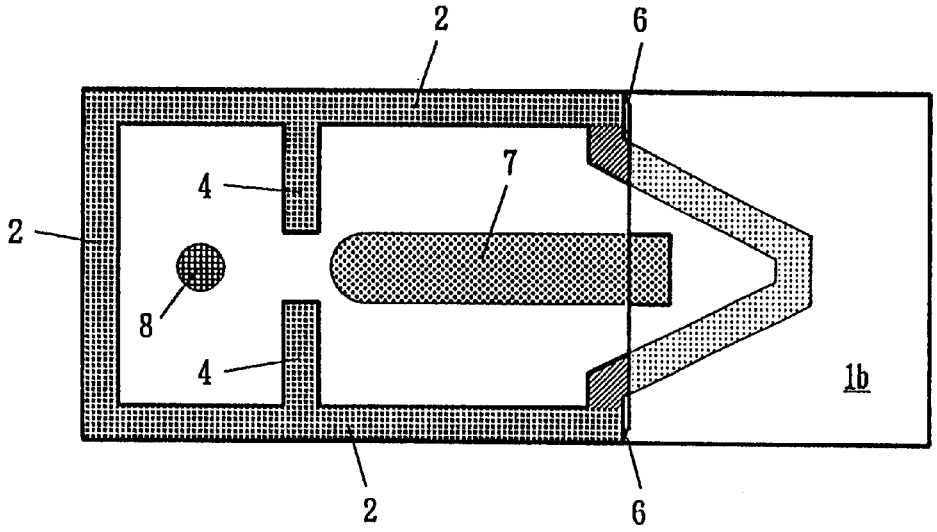
FIG. 3 is a plan view showing the opened easy-to open packing bag according to the first embodiment.
Figure 4:
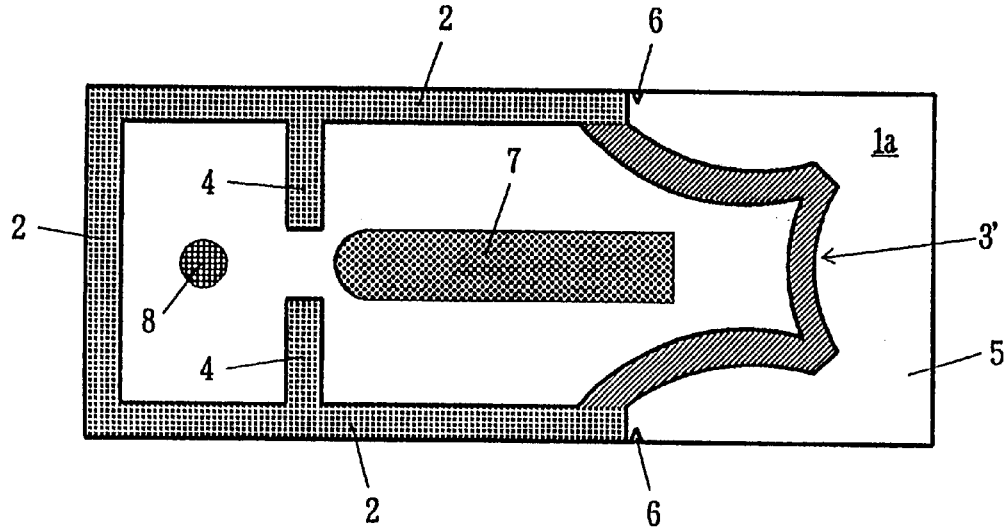
FIG. 4 is a plan view showing a second embodiment.
Figure 5:
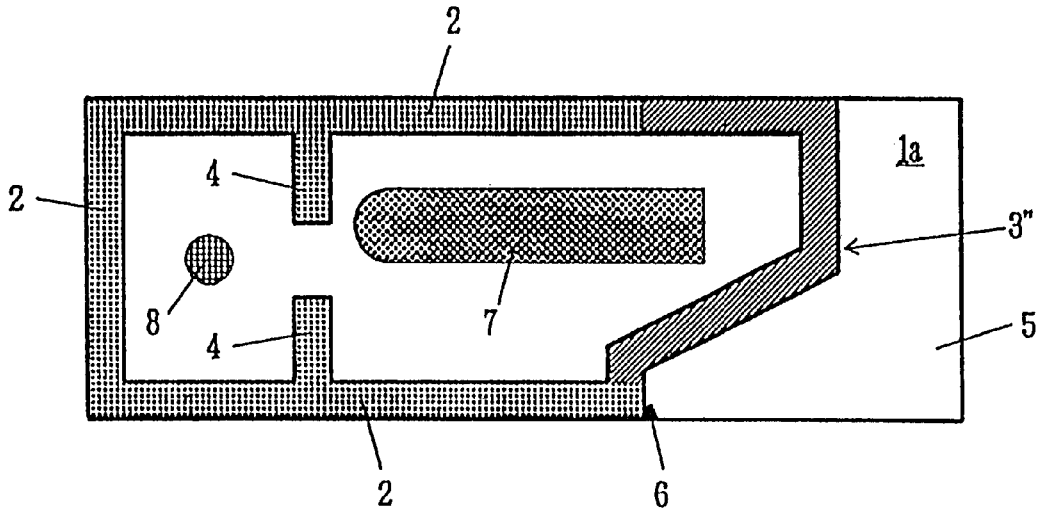
FIG. 5 is a plan view showing a third embodiment.
Figure 6:
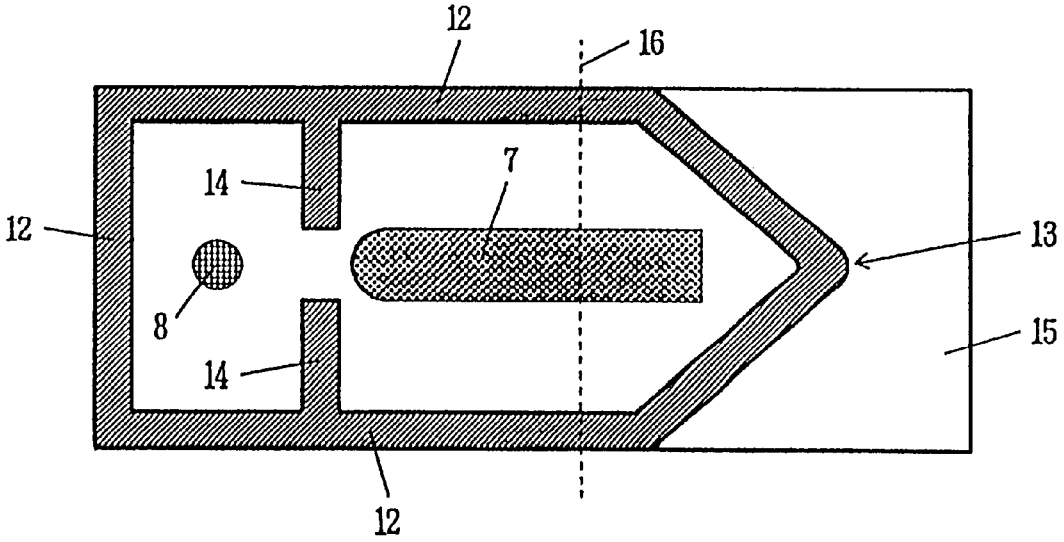
Fig. 6 PRIOR ART
FIG. 6 is a plan view showing a conventional easy-to-open packing bag.
Figure 7:
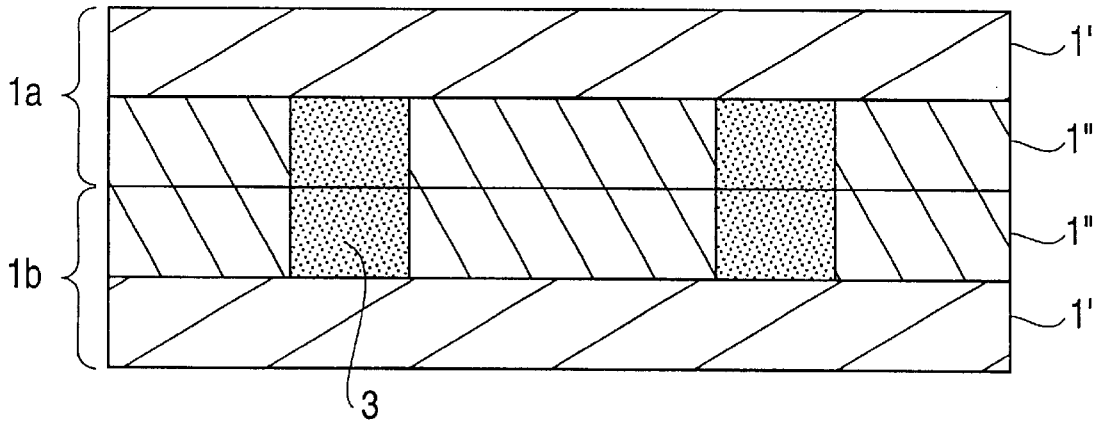
FIG. 7 is a cross section along lines VII—VII of FIG. 1, schematically illustrating a substrate layer and a thermoplastic resinous layer.
Figure 8:
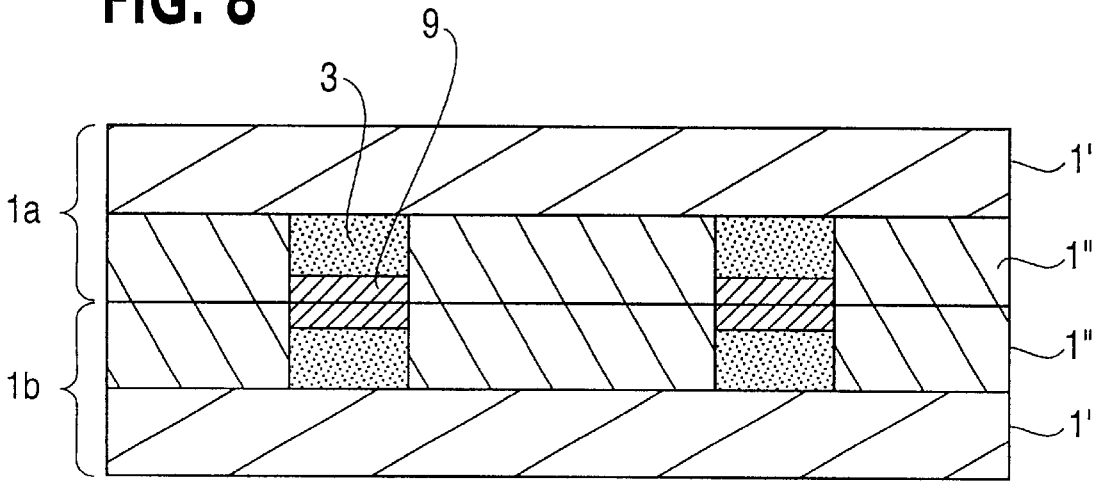
FIG. 8 is similar to FIG. 7 but further schematically illustrating a heat bonding strength adjusting layer.

FIG. 2 shows the easy-to-open packing bag according to the first embodiment being opened. FIG. 3 is a plan view showing the opened easy-to-open packing bag according to the first embodiment. FIG. 4 is a plan view showing a second embodiment. FIG. 5 is a plan view showing a third embodiment. Reference numerals 1*a* and 1*b* denote packing films, respectively; 2 denotes a peripheral heat-bonding portion; 3, 3', and 3' denote projected heat-bonding portions, respectively; 4 denotes a partitioning heat-bonding portion; 5 denotes a nonbonding portion; 6 denotes a notch; 7 denotes a content; and 8 denotes a drying agent.

As shown in FIG. 1, in the easy-to-open packing bag according to the first embodiment of the present invention, rectangular external and internal packing films 1*a* and 1*b* each consisting of a backing (or substrate) layer 1, and a thermoplastic resinous layer 1" are laminated on each other, with surfaces of the thermoplastic resinous layer opposed to each other. A predetermined region extending inward from one of the shorter sides of each of the packing films 1*a* and 1*b* is formed as the non-bonding portion 5 on each of the packing films 1*a* and 1*b*. The U-shaped peripheral heat-bonding portion 2 is formed on each of the packing films 1*a* and 1*b* along the three sides thereof including the other shorter side. The partitioning heat-bonding portion 4 is formed to the peripheral heat-bonding portion 2 of each of the packing films 1*a* and 1*b* such that the partitioning heat-bonding portions 4 are opposed to each other. The projected heat-bonding portion 3 connecting both ends of the peripheral heat-bonding portion 2 with each other and projected outward is formed on each of the packing films 1*a* and 1*b*. The notches 6 are formed on opposite edges of the non-bonding portion 5 of the external packing film 1*a* such that each notch 6 is located at a position adjacent to an end of the peripheral heat-bonding portion 2. By using an easily separable resinous layer as the thermoplastic resinous layer, the projected heat-bonding portion 3 of the packing film 1*a* and that of the packing film 1*b* are separably thermally connected with each other, and the peripheral heat-bonding portion 2 of the packing film 1*a* and that of the packing film 1*b* are separably thermally connected with each other. Otherwise, by forming a heat-bonding strength adjusting layer 9 in region on the surface of the thermoplastic resinous layer 1, each of the packing films 1*a* and 1*b*, on which the projected heat-bonding portion 3 is to be formed, only the projected heat-bonding portions 3 are separably thermally connected with each other.

In the first embodiment, one of the notches 6 is formed on the edge of each of the opposite sides of the external packing film 1*a*. But the notch 6 may be formed on only one of the edges. In this case, the easy-to-open packing bag is opened by separating the projected heat-bonding portions 3 from each other by picking up the corner of the non-bonding portion 5 located at the notch-formed side of the external packing film 1*a*. By forming the notch 6 on the edge of the external packing film 1*a*, it is possible to cut off only a portion of the packing film 1*a* located at the side of the non-bonding portion 5 with respect to the notch 6. Thus, it is possible to expose an end of the content 7 to the outside, with the content 7 placed on the internal packing film 1*b*, and prevent both the packing films 1*a* and 1*b* from being erroneously cut off at the notch 6. Thus, there is no possibility that the content 7 is damaged. The notch 6 is V-shaped in the embodiment, but the configuration of the notch 6 may be optional. For example, the notch 6 may be linearly formed. The partitioning heat-bonding portion 4 is formed to partition a content accommodating space and a drying agent-accommodating space from each other. Depending on the kind of the content 7, it is not necessary to form the partitioning heat-bonding portion 4.

Describing the method of opening the easy-to-open packing bag of the first embodiment, as shown in FIG. 2, the lower corner of the non-bonding portion 5 of the packing film 1*a* and that of the non-bonding portion 5 of the packing film 1*b* are picked up with fingers and pulled in opposite directions. As a result, an outward end of the projected heat-bonding portion 3 and that of the projected heat-bonding portion 3 separate from each other, and only the external packing film 1*a* having the notch 6 formed thereon starts to tear from the notch 6. As the separation is continued, both projected heat-bonding portions 3 separate inward from each other from the corner thereof, while the packing film 1*a* tears upward from the notch 6. When both projected heat-bonding portions 3 separate almost completely, the packing film 1*a* tears off and the non-bonding portion 5 of the film 1*a* is cut off, as shown in FIG. 3. In the state shown in FIG. 3 in which the non-bonding portion 5 located at one side of the external packing film 1*a* with respect to the notch 6 is cut off, a part of the content 7 is exposed to the outside, with the content 7 placed on the internal packing film 1*b*. Because the notch 6 is formed on only the external packing film 1*a*, when the easy-to-open packing bag is opened, the state as shown in FIG. 3 is realized. Although the method of separating both projected heat-bonding portions 3 from each other by picking up the lower corner of the non-bonding portion 5 of each of the packing films 1*a* and 1*b* has been described with reference to FIG. 2, the easy-to-open packing bag can be also opened easily by picking up the upper corner of the non-bonding portion 5 of each of the packing films 1*a* and 1*b*. In the case where the easy-to-open packing bag accommodates the blood sugar value measuring electrode as the content 7, a blood sugar value can be measured by impregnating an exposed portion thereof with blood.

The easy-to-open packing bag according to the second embodiment of the present invention is as shown in FIG. 4. A projected heat-bonding portion 3' is shaped as a projection by combining curved lines with each other. Because the projected heat-bonding portion 3' has such a it configuration, by picking up the upper or lower corner of the non-bonding portion 5 of each of the packing films la and 1*b* with fingers and by pulling the projected heat bonding portions 3' of the internal and external packing films 1*a* and 1*b* in opposite direction, both projected heat-bonding portions 3' each having a narrow heat-bonding area separate from each other from the corner thereof, while the packing film 1*a* starts to tear from the notch 6. Therefore, a small force is required to separate the corners of both projected heat-bonding portion 3' from each other and to tear the packing film 1*a* from the notch 6, which facilitates the separation of the projected heat-bonding portion 3'.

The easy-to-open packing bag according to the third embodiment of the present invention is as shown in FIG. 5. A projected heat-bonding portion 3" is shaped as a projection by making only the notch-formed side oblique, and the notch 6 is formed at only one side of the packing film 1*a*. The lower corner of each of the packing films 1*a* and 1*b* is picked up with fingers, and the projected heat-bonding portion 3" are separated from each other. As a result, the non-bonding portion 5 located at one side of the external packing film 1*a* with respect to the notch 6 is cut off from the notch 6. Thus, an end of the content 7 can be exposed to the outside. In the third embodiment, although both projected heat-bonding portions 3" can separate from each other only from the lower corner of the non-bonding portion 5, it is possible to reduce the vertical dimension of the easy-to-open packing bag and thus reduce the area of the packing film. Therefore, it is possible to reduce the cost.

The packing film 1 for use in the easy-to-open packing bag of the present invention consists of a laminate of a backing layer (substrate layer) and a thermoplastic resinous layer. As the thermoplastic resinous layer, an easily separable resin is used. Otherwise, the heat-bonding strength adjusting layer is formed in the region of the surface of the thermoplastic resinous layer corresponding to the projected heat-bonding portions 3, 3', and 3". As the backing layer, a laminate of any one pair of the following films is used: a heat-resistant film such as a biaxially oriented polyethylene terephthalate film, a biaxially oriented polypropylene film, or a biaxially oriented nylon; and a gas barrier film such as a metal or metal oxide layer-evaporated biaxially oriented polyethylene terephthalate film, an aluminum foil, and a biaxially oriented plastic film coated with polyvinylidene chloride resin. As the easily separable resin, SMX-Y03 and SMX-Y04 (by Wada Kagaku Kogyo Ltd.) can be preferably used. The SMX-Y03 and SMX-Y04 are multi-layer films whose thermal adhesive surfaces consist of specialty polymer alloy of polyethylene, polypropylene, and polystyrene. As the thermoplastic resinous layer wherein the region of the surface of the thermoplastic resinous layer corresponding to the projected heat-bonding portions 3, 3', and 3" is made easily separable by applying the heat-bonding strength adjusting layer thereto, it is possible to use low concentration polyethylene, linear low concentration polyethylene, intermediate concentration polyethylene, polypropylene, ethylene-propylene copolymer, a blend of polypropylene and polyethylene. Resin that can be used as the heat-bonding strength adjusting layer includes ethylene-vinyl acetate copolymer, ethylene-acrylate copolymer, and ethylene-methacrylate copolymer. These resins are applied in the form of aqueous emulsion to the surface of the thermoplastic resinous layer consisting of the above-described resins.

In the case where the easily separable resin is used as the thermoplastic resinous layer, each of the packing films 1*a* and 1*b* consists of, for example, polyethylene terephthalate/printed layer/adhesive agent layer/aluminum-evaporated biaxially oriented polyethylene terephthalate/adhesive agent layer/easily separable resin (SMX-Y04). In the case where the easily separable nature is realized by using the heat-bonding strength adjusting layer, each of the packing films 1*a* and 1*b* consists of, for example, polyethylene terephthalate/adhesive agent layer/printed layer/aluminum-evaporated biaxially oriented polyethylene terephthalate/linear low concentration polyethylene/heat-bonding strength adjusting layer (ethylene-vinyl acetate copolymer). The ethylene-vinyl acetate copolymer as the heat-bonding strength adjusting layer is applied in the form of aqueous emulsion to the surface of the linear low concentration polyethylene.

In the case where the easily separable resin is used as the thermoplastic resinous layer, it is possible to manufacture the thermoplastic resinous layer by utilizing the ordinary method of forming the printed layer on the surface of the polyethylene terephthalate, and then laminating the other layers one upon another. In the case where the heat-bonding strength adjusting layer is applied on the surface of the thermoplastic resinous layer, the thermoplastic resinous layer, for example the linear low concentration polyethylene, is laminated on one surface of the aluminum-evaporated biaxially oriented polyethylene terephthalate to form a laminate, the printed layer is formed on the other surface of the aluminum-evaporated biaxially oriented polyethylene terephthalate of the laminate, and at the same time, the ethylene-vinyl acetate copolymer in the form of aqueous emulsion is applied to a predetermined region of the linear low concentration polyethylene corresponding to the printed layer, namely, to the region thereof to be formed as the projected heat-bonding portions 3, 3', and 3", so that the heat-bonding strength adjusting layer is formed. The printed layer and the heat-bonding strength adjusting layer are formed with a printing machine by in-line system. In the final stage, the aluminum-evaporated biaxially oriented polyethylene terephthalate is laminated on the printed layer.

To form the notch 6 on the external packing film 1*a*, the notch 6 is formed at a predetermined position of the external packing film 1*a* corresponding to the printed layer slit with a predetermined width. Otherwise, the notch 6 is formed at a predetermined position of the external packing film 1*a* corresponding to the printed layer in a process of packing the content 7 in the easy-to-open packing bag with an automatic charging packing machine.

In the easy-to-open packing bag, the external and internal rectangular packing films each consisting of the backing layer and the thermoplastic resinous layer are laminated on each other, with surfaces of the thermoplastic resinous layers opposed to each other; the predetermined region extending inward from one of the shorter sides of each of the packing films is formed as the non-bonding portion; the U-shaped peripheral heat-bonding portion is formed on each of the packing films along the other three sides thereof; the projected heat-bonding portion, connecting both ends of the peripheral heat-bonding portion with each other and projected outward, is formed; at least the projected beat-bonding portion is separably sealed; and the notch is formed on at least one edge of at least the external packing film such that the notch is located at the position adjacent to one end of the peripheral heat-bonding portion. In this case, the corner of the non-bonding portion of the external packing film and that of the non-bonding portion of the internal packing film are picked up with fingers and pulled in opposite directions. As a result, the outward end of the projected heat-bonding portion of the external packing film and that of the projected heat-bonding portion of the internal packing film separate from each other, and at the same time, the external packing film starts to tear from the notch. As the operation to separate them continues, both projected heat-bonding portions separate from each other, and the external packing film is torn. That is, the non-bonding portion of the external packing film is removed to expose the content, so that the content can be taken out easily.

In the easy-to-open packing bag, the heat-bonding strength of the projected heat-bonding portion is set to 500–2000 g per 15 mm width, so that the projected heat-bonding portions can be separated from each other easily when the corner of the non-bonding portion of the external packing film and that of the non-bonding portion of the internal packing film are picked up with fingers and pulled in opposite directions.

In the easy-to-open packing bag, the heat-bonding strength of the projected heat-bonding portion is set lower than that of the peripheral heat-bonding portion so that even when an excess force is applied to the two packing films in separating the projected heat-bonding portions from each other, there is no possibility that two films are separated from each other and that the content drops from the easy-to-open packing bag.

In the easy-to-open packing bag, the heat-bonding strength adjusting layer is applied to the region of the surface of the thermoplastic resinous layer of each packing film on which the projected heat-bonding portion is to be formed. In this manner, the projected heat-bonding portions are separable from each other.

What is claimed is:

1. An easy-to-open packing bag, comprising:

a pair of rectangular-shaped packing films, each of which comprises a substrate layer and a thermoplastic resinous layer, said packing films being laminated on each other with surfaces of said thermoplastic resinous layers being opposed to each other;

a U-shaped peripheral heat-bonding portion being formed on three other sides of said packing films; and a projected heat-bonding portion, connecting a pair of ends of said peripheral heat-bonding portion and projecting outwardly, formed on said packing films;

wherein a predetermined region on one side of said packing films is formed as a non-heat-bonding portion;

wherein at least said projected heat-bonding portion is separably sealed; and wherein a notch is formed on at least one of a pair of edges of an external one of the packing films at a position adjacent to one end of said peripheral heat-bonding portion.

2. The easy-to-open packing bag according to claim 1, wherein a heat-bonding strength of said projected heat-bonding portion is set to 500–2000 g per 15 mm width.

3. The easy-to-open packing bag according to claim 1, wherein a heat-bonding strength of said projected heat-bonding portion is set lower than that of said peripheral heat-bonding portion.

4. The easy-to-open packing bag according to claim 1, wherein a heat-bonding strength of said projected heat-bonding portion is set to 500–2000 g per 15 mm width, and wherein said heat-bonding strength of said projected heat-bonding portion is set lower than that of said peripheral heat-bonding portion.

5. The easy-to-open packing bag according to claim 1, further comprising, for at least one of said packing films, a heat-bonding strength adjusting layer which is provided on a surface, of said thermoplastic resinous layer, corresponding to a region in which said projected heat-bonding portion is to be formed.

6. The easy-to-open packing bag according to claim 1, further comprising, for at least one of said packing films, a heat-bonding strength adjusting layer which is provided on a surface, of said thermoplastic resinous layer, corresponding to a region in which said projected heat-bonding portion is to be formed, wherein a heat-bonding strength of said projected heat-bonding portion is set to 500–2000 g per 15 mm width.

7. The easy-to-open packing bag according to claim 1, further comprising, for at least one of said packing films, a heat-bonding strength adjusting layer which is provided on a surface, of said thermoplastic resinous layer, corresponding to a region in which said projected heat-bonding portion of said packing film is to be formed, wherein a heat-bonding strength of said projected heat-bonding portion is set lower than that of said peripheral heat-bonding portion.

8. The easy-to-open packing bag according to claim 1, further comprising, for at least one of said packing films, a heat-bonding strength adjusting layer which is provided on a surface, of said thermoplastic resinous layer, corresponding to a region in which said projected heat-bonding portion of said packing film is to be formed, wherein a heat-bonding strength of said projected heat-bonding portion is set to 500–2000 g per 15 mm width, and wherein said heat-bonding strength of said projected heat-bonding portion is set lower than that of said peripheral heat-bonding portion.

9. An easy-to-open packing bag, comprising:

a pair of rectangular-shaped packing films, each of which comprises a substrate layer and a thermoplastic resinous layer, said packing films being laminated on each other with surfaces of said thermoplastic resinous layers being opposed to each other;

a U-shaped peripheral heat-bonding portion being formed on three other sides of said packing films; and a projected heat-bonding portion, connecting a pair of ends of said peripheral heat-bonding portion and projecting outwardly, formed on said packing films;

wherein a predetermined region on one side of said packing films is formed as a non-heat-bonding portion;

wherein at least said projected heat-bonding portion is separably sealed;

wherein notches are respectively formed on a pair of edges of an external one of the packing films at a position adjacent to one end of said peripheral heat-bonding portion; and wherein as an operation to separate said packing films at the projected heat-bonding portion from each other proceeds, said external one of said packing films tears from one of said notches to the other of said notches, so that a part of said external one of said packing films can be cut off.

10. The easy-to-open packing bag according to claim 9, wherein a heat-bonding strength of said projected heat-bonding portion is set to 500–2000 g per 15 mm width.

11. The easy-to-open packing bag according to claim 9, wherein a heat-bonding strength of said projected heat-bonding portion is set lower than that of said peripheral heat-bonding portion.

12. The easy-to-open packing bag according to claim 9, wherein a heat-bonding strength of said projected heat-bonding portion is set to 500–2000 g per 15 mm width, and wherein said heat-bonding strength of said projected heat-bonding portion is set lower than that of said peripheral heat-bonding portion.

13. The easy-to-open packing bag according to claim 9, further comprising, for at least one of said packing films, a heat-bonding strength adjusting layer which is provided on a surface, of said thermoplastic resinous layer, corresponding to a region in which said projected heat-bonding portion is to be formed.

14. The easy-to-open packing bag according to claim 9, further comprising, for at least one of said packing films, a heat-bonding strength adjusting layer which is provided on a surface, of said thermoplastic resinous layer, corresponding to a region in which said projected heat-bonding portion is to be formed, wherein a heat-bonding strength of said projected heat-bonding portion is set to 500–2000 g per 15 mm width.

15. The easy-to-open packing bag according to claim 9, further comprising, for at least one of said packing films, a heat-bonding strength adjusting layer which is provided on a surface, of said thermoplastic resinous layer, corresponding to a region in which said projected heat-bonding portion is to be formed, wherein a heat-bonding strength of said projected heat-bonding portion is set lower than that of said peripheral heat-bonding portion.

16. The easy-to-open packing bag according to claim 9, further comprising, for at least one of said packing films, a heat-bonding strength adjusting layer which is provided on a surface, of said thermoplastic resinous layer, corresponding to a region in which said projected heat-bonding portion is to be formed, wherein a heat-bonding strength of said projected heat-bonding portion is set to 500–2000 g per 15 mm width, and wherein said heat-bonding strength of said projected heat-bonding portion is set lower than that of said peripheral heat-bonding portion.

* * * * *